US011383372B2

(12) United States Patent
Avalos

(10) Patent No.: US 11,383,372 B2
(45) Date of Patent: Jul. 12, 2022

(54) ADJUSTABLE LENGTH HANDLE

(71) Applicant: Guillermo Avalos, Livingston, CA (US)

(72) Inventor: Guillermo Avalos, Livingston, CA (US)

( * ) Notice: Subject to any disclaimer, the term of this patent is extended or adjusted under 35 U.S.C. 154(b) by 239 days.

(21) Appl. No.: 16/655,214

(22) Filed: Oct. 16, 2019

(65) Prior Publication Data

US 2020/0086474 A1 Mar. 19, 2020

Related U.S. Application Data

(63) Continuation-in-part of application No. 15/684,916, filed on Aug. 23, 2017, now abandoned.

(51) Int. Cl.

| | |
|---|---|
| ***B25G 1/04*** | (2006.01) |
| ***B25B 23/00*** | (2006.01) |
| ***B25B 23/16*** | (2006.01) |

(52) U.S. Cl.

CPC ..... *B25G 1/043* (2013.01); *B25B 23/0021* (2013.01); *B25B 23/16* (2013.01)

(58) Field of Classification Search

CPC ..... B25G 1/043; B25B 23/0021; B25B 23/16
USPC ..... 81/177.2
See application file for complete search history.

(56) References Cited

U.S. PATENT DOCUMENTS

| | | | | |
|---|---|---|---|---|
| 662,748 A | | 11/1900 | Wood | |
| 1,243,508 A | * | 10/1917 | Gorton | A47B 9/20 108/147.19 |
| 1,284,351 A | | 11/1918 | Jagielo | |
| 1,951,754 A | | 3/1934 | Gilbert | |
| 2,483,396 A | | 10/1949 | Benson | |
| 2,520,652 A | | 8/1950 | Pfauser et al. | |
| 4,070,932 A | | 1/1978 | Jeannotte | |
| 4,367,663 A | | 1/1983 | Merics | |
| 4,440,517 A | | 4/1984 | Potter et al. | |
| 4,581,958 A | | 4/1986 | Shull | |
| 4,905,548 A | | 3/1990 | Colace et al. | |
| 5,109,737 A | | 5/1992 | Raber | |
| 5,363,727 A | * | 11/1994 | Barth | B25G 1/043 81/177.2 |
| 5,392,673 A | | 2/1995 | Scott | |
| D392,527 S | | 3/1998 | Cortes et al. | |

(Continued)

*Primary Examiner* — Hadi Shakeri
(74) *Attorney, Agent, or Firm* — Sierra IP Law, PC; William K. Nelson

(57) ABSTRACT

An adjustable length handle having a first handle member, a tubular shaped second handle member and an adjusting mechanism interconnecting the two handle members to shorten or lengthen the handle length. The second handle member has an interior channel that receives the first handle member. An inner surface of the channel is in opposing relation to an outer surface of the first handle member. The adjusting mechanism comprises a longitudinally disposed length adjusting slot and one or more laterally disposed engaging slots in the inner surface that receive an engaging member which extends outward from the outer surface of the first handle member. When in the length adjusting slot, the engaging member allows linear movement of one handle member relative to the other handle member to adjust the handle length. When in one of the engaging slots, the engaging member prevents such linear movement to fix the handle length.

20 Claims, 10 Drawing Sheets

(56) References Cited

U.S. PATENT DOCUMENTS

| | | | |
|---|---|---|---|
| 5,911,798 | A | 6/1999 | Arnold |
| 5,927,161 | A | 7/1999 | Clifford et al. |

* cited by examiner

ADJUSTABLE LENGTH HANDLE

FIELD OF THE INVENTION

The present invention relates generally to handles that are attached to or otherwise utilized with hand-held tools and the like. In particular, the present invention relates to such handles that are specifically configured to be easily and quickly shortened or lengthened, as desired by the person using the handle to accomplish a work task. Even more particularly the present invention relates to such handles which are specially adaptable for use with torque applying tools, such as a ratchet, wrench, breaker bar and the like, and for use as an extendable pole for mops, brooms, brushes, umbrellas and other sun covers, walking or skiing poles, table legs, and the like.

BACKGROUND OF THE INVENTION

The statements in this section merely provide background information related to the present disclosure and may not constitute prior art.

Many hand-held tools have handles which the user grasps when he or she is using the tool to accomplish the desired work objective with the work portion of the tool. Most handles are attached to or integral with the work portion of the tool and are of a fixed length, meaning that the length of the handle cannot be changed without disconnecting from the work portion of the tool. Examples of such tools are conventionally configured ratchets, wrenches, hammers, screwdrivers and the like. Likewise most commercially available mops, brooms, brushes and the like (for the present disclosure, these are also referred to as tools) have a fixed length handle, which may be relatively short (i.e., six to twelve inches) or somewhat long (four to six feet) that is attached to or integral with the work portion of the tool. As generally known to persons who are skilled in the art, such tools are commonly available with different sized work portions and with different lengths of handles (though the handle is a fixed length).

The circumstances pertaining to the common uses of a tool are such that having a fixed length handle attached to or integral with the work portion of the tool is sufficient, or at least adequate, for the user of the tool to accomplish the desired work objective. In certain circumstances, having a tool with a fixed length handle can present one or more problems for the user. One such circumstance is when the handle of the tool is not long enough for the user to reach the object on or at which he or she desires to utilize the work portion of the tool to accomplish the particular work objective. For instance, many machines have components that are located on the interior of the machine at a distance that is somewhat away from the exterior surface of the machine where the machinist, operator, repair person or other person is located. The person needing to accomplish the work objective with a tool, such as a ratchet, wrench, breaker bar or the like often cannot reach the interior areas of the machine in order to use the tool to engage the interior component with the tool. Another circumstance where a single, fixed length handle may limit or even prevent a person from accomplishing a work objective is when the person must use the tool to apply torque to a work object, such as a bolt, nut, screw or the like, to loosen or adequately tighten the work object. As will be readily appreciated by persons skilled in the art, a longer length handle allows the user of the tool to apply more torque to the work object. In other circumstances, the handle of a tool may be too long for certain uses. For instance, a tool with a longer length handle may be difficult, if not impossible, to maneuver into or through a machine to the location where the work portion of the tool can be utilized to operatively engage a work object, such as a bolt, to accomplish the necessary work objective (i.e., to apply torque to loosen or tighten the work object).

Perhaps the most common solution to having a tool with a handle that is either too short or too long is to swap the tool out for another tool that has a handle which is more useful, functional and/or otherwise appropriate for engaging the work object to accomplish the work objective. As will be readily appreciated by persons who are skilled in the art, because the person usually has to stop doing what he or she is doing, find the correct sized tool (which may take several tries) and repeat the effort to accomplish the desired task, swapping out one tool for another tool can be both time consuming and somewhat frustrating to the person trying to accomplish the task. Another solution is to use an extension rod, tube or like member that engages the handle of the tool in a manner which increases the length between the user's hand and the work portion of the tool to provide extra reach for the tool. Although extension members may be useful in many types of circumstances, they still require the user to stop what he or she is doing, find the correct size extension member and then re-attempt the work objective. In addition, these extension members generally do not help the person who needs the tool to have a shorter handle.

Yet another solution to the problem of having a tool with a handle that is not of the correct or desirable size to accomplish a work objective is for the person to utilize a tool having an adjustable length handle. In fact, a wide variety of different types of adjustable length handles are described in the prior art, including adjustable length handles utilized for ratchets, wrenches, breaker bars and the like that are utilized to apply torque to an object. Substantially all prior art adjustable handles utilized an inner handle member and an outer handle member that are, at least to some extent, telescopically arranged such that the two handle members move relative to each other along the longitudinal axis of the handle. The same is true for poles used as the handle or leg of an umbrella, or as legs for sun covers or adjustable height tables, and the like. A number of the conventional adjustable length handles and poles utilize a detent device or mechanism that moves a ball or other object into engagement with a round, rectangular or other cooperatively shaped aperture to lock the handle at the user's desired length. Most detent devices require the user to manually push or otherwise manipulate a portion of the detent device, which typically comprises a spring or other biasing device, into and out of the aperture. Other conventional adjustable length handles have a latching mechanism that is associated with one of the handle members and is configured to engage a portion of the other handle member to lock the handle at the desired length. Yet other prior art adjustable length handles utilize a compression type of arrangement wherein the outer handle member (typically) is rotated or otherwise manipulated to securely tighten the compression mechanism against the inner handle member to fix the length of the handle. This latter type of adjustable length handle is particularly common in handles used for brooms, mops, brushes, skiing poles, walking/hiking poles and the like. A variety of other types of length adjusting mechanisms are utilized with the prior art adjustable length handles to lengthen or shorten the handle based on the user's particular needs when he or she is using the handle.

As well known in the art, the various prior art adjustable devices or mechanisms can be somewhat difficult for the user to manipulate under actual working conditions and are subject to being clogged or otherwise becoming inoperable or having reduced function due to dirt, grease and other materials, or moisture leading to rust. For instance, the adjustable length handles having a detent device or mechanism often require the user to push the ball or other detent with his or her finger and then extend the inner handle member relative to the outer handle member. Even when clean, some of the detent devices are difficult to push. When the detent device/mechanism, or the user's hand, is covered with grease, dirt or other materials, it can be nearly impossible for the user to easily engage the detent and unlock the device/mechanism to shorten or lengthen the handle. The latching operation of the adjustable length handles that utilize a latching mechanism to lock/unlock the inner and outer handle members so the user can adjust the length of the handle tend to be easily compromised by grease, dust and like materials. In addition, the latching mechanisms can become damaged by inadvertent contact with other objects during use of the tool. The compression type adjusting mechanisms are also subject to interference by grease, dirt and other "messy" materials and damage from inadvertent contact with other objects. In addition, over time one or more components of the compression mechanism tends to wear and, as a result, the mechanism is no longer able to provide the necessary engagement to tightly hold the inner and outer handle members together.

Further, conventional systems which provide a tab and slot mechanism for engaging the inner and outer handles often comprise a single longitudinal slot with short lateral engagement slots branching off therefrom. These lateral engagement slots typically comprise a short, distal longitudinal slot which requires an extra longitudinal movement in order to fully engage the tab, and allow for some longitudinal movement of the outer member while the tool is in use. For many applications, such as wrenching, this longitudinal movement prevents a solid grip while significant force is being applied to the handle, potentially leading to slippage and injury to the user's hand or damage to the tool or machine/object being worked on. Additionally, for those systems which do not include a distal longitudinal slot, the lateral slot is typically circumferentially short (e.g., comprise an arc length along the perimeter of the inner member of approximately 45 degrees or less). In such systems, when the tool is being used to pull or wrench on an object, the outer member may easily be accidentally disengaged due to the normal twisting which may occur in the user's wrist during use. Longer lateral slots would prevent such issues, such that a user holding the handle in a normal working grip would have to significantly twist his or her wrist, or let go of the handle entirely, in order for the tab to disengage from a lateral slot.

Finally, for systems including adjustable length poles which require significant strength against longitudinal compressive force, conventional detent mechanisms, circumferential tightening systems, and typical single-tab and slot systems, often limit the utility of the tool/pole/table. Such systems are not able to provide significant strength to hold up or resist a substantially heavy weight, wherein tables utilizing detents for adjustable length legs cannot be loaded with heavy items, and skiing or hiking poles utilizing twist-tighten mechanisms require constant and time-consuming readjustment. Other problems are also well known in the art.

What is needed, therefore, is an improved adjustable length handle that allows the user to quickly, easily and effectively change the overall length of the handle of a tool as is necessary or beneficial for the user to accomplish his or her work objective. The new adjustable length handle should be adaptable for use with a wide variety of different types of tools, including those which are utilized to apply torque to a work object. Preferably, the new adjustable length handle is also adaptable for being integrally formed with or attached to, including being removably attached, to a work portion of a tool. The new adjustable length handle should also be adaptable for being manufactured in a wide range of different lengths, whether relatively short or very long, and suitable for being made out of a wide range of materials. To overcome problems common with prior art handles, an improved adjustable length handle should be structured and arranged so as to reduce the likelihood that grease, dirt and other materials will interfere with the ability of the user to easily and quickly shorten or lengthen the handle as needed. Likewise, the new adjustable length handle should be less subject to damage that results in the adjusting mechanism becoming nonfunctional as a result of contact with other objects. In a preferred configuration, the new adjustable length handle should be configured to be relatively inexpensive to manufacture.

SUMMARY OF THE INVENTION

The adjustable length handle of the present invention provides the benefits and solves the problems identified above. That is to say, the adjustable length handle of the present invention is structured and arranged to allow a person to quickly, easily and effectively change the overall length of the handle of a tool as the user deems necessary or beneficial to accomplish his or her work objective. In the preferred configurations of the present invention, the adjustable length handle is adaptable for use with a wide variety of different types of tools, including tools that are or may be utilized to apply torque to a work object, including nuts, bolts and the like.

The new adjustable length handle of the present invention can be integrally formed with or attached, including being removably attached, to a variety of different types of work portions to form a tool. In some embodiments, the work portion of the tool may comprise a ratchet, a socket, a lever, a cylinder, a claw, a net, a foot, a brush, and the like. The adjustable length handle of the present invention is also adaptable for being manufactured in a manner that can produce a wide range of different length handles, whether relatively short or very long. The new adjustable length handle of the present invention can be manufactured out of a wide range of materials. In the preferred embodiments of the present invention, the adjustable length handle is structured and arranged to reduce the likelihood that grease, dirt and other materials will interfere with the ability of the user to easily and quickly adjust the handle length as needed, thereby overcoming one of the most common problems with prior art adjustable handles. The new adjustable length handle of the present invention is also much less subject to being damaged, which could result in the handle no longer being able to adjust in length, as a result of contact with other objects. In the preferred embodiments, the new adjustable length handle of the present invention is configured to be relatively inexpensive to manufacture.

In one embodiment, the new adjustable length handle of the present invention generally comprises a first handle member, a tubular shaped second handle member and an adjusting mechanism that moveably interconnects the two handle members to allow the user to quickly and easily shorten or lengthen the length of the handle. The first handle member has a handle body with a first end, a second end and an outer surface. The second handle member has a handle body, a first end, a second end, an outer surface and an interior channel. The interior channel defines an inner surface. The first handle member is moveably received in the interior channel such that the outer surface of the first handle member is in opposing relation to the inner surface of the interior channel. The handle members define a longitudinal axis of the handle. Either handle member may be attached to, including removably, or integral with a work portion to form a tool. The work portion of the tool may be attached to the extendable handle in a removable manner, such as by threading onto the handle, clamping onto the handle, engaging the handle via an outer socket with a detent, another similar mode of attaching two mechanical parts, or a combination thereof.

The adjusting mechanism interconnects the outer surface of the first handle member and the inner surface of the second handle member. In the preferred embodiment, the adjusting mechanism comprises an engaging member that extends outwardly from the outer surface of the handle body of the first handle member, a length adjusting slot that is longitudinally disposed in the inner surface of the second handle member and one or more engaging slots that are disposed in the inner surface of the second handle member. Each of the engaging slots have a first end that is passably connected to the length adjusting slot and a second end that is in spaced apart relation to the length adjusting slot. Each of the engaging member, length adjusting slot and engaging slots are cooperatively sized and configured so the engaging member can move, typically slidably, along the length adjusting slot when the handle is in a disengaged condition and move into the engaging slots to place the handle in an engaged condition. When the handle is in its disengaged condition, the adjusting mechanism allows linear movement of one of the handle members relative to the other handle member along the longitudinal axis of the handle to allow the user to easily move the handle between a retracted position and an extended position so he or she may select a handle length for the handle. Upon rotational movement of one handle member relative to the other handle member, the engaging member moves from the length adjusting slot into one of the engaging slots to prevent any linear movement of the handle members relative to each other to fixedly establish the handle length. In one embodiment, each engaging slot has a secondary shaped section at the second end that receives the engaging member when the handle is in its engaged condition.

In some embodiments, the engaging slots may comprise a length which represents an increased arc length around the inner or outer handle member, so as to allow for a greater margin of error without the engaging member disengaging from an engaging slot when the user twists his or her wrist while the tool is in use. In some embodiments, the engaging slots may each comprise an arc in a range from about 30 degrees to about 180 degrees, and all values or ranges of values in between (e.g., from about 45 degrees to about 150 degrees, from about 60 degrees to about 120 degrees, from about 80 degrees to about 100 degrees, and the like). In some embodiments, the engaging slots may each comprise an arc of about 90 degrees (e.g., from about 85 degrees to about 95 degrees). In some embodiments, the engaging slots may each comprise an arc of at least 90 degrees. The engaging slots of the present invention may thereby prevent accidental disengagement of the engaging member due to a normal flexion of the wrist which may occur while using the handle of the present invention to perform a task. However, a user may still be able to adjust a length of the handle with one hand and without taking the work end away from the work (e.g., without taking the socket off of the bolt), by intentionally twisting the handle.

In some embodiments, the present invention may comprise a releasing lateral slot, the releasing lateral slot providing a path from the lengthening slot to a releasing longitudinal slot. The releasing lateral slot may comprise an orientation and shape similar to the engaging slots, and may be arranged at an end of the lengthening slot. The releasing longitudinal slot provide a path which allows the engaging member to exit from the respectively opposite handle member (e.g., if the engaging member is located on the inner member, the releasing longitudinal slot may provide a path for the engaging member to exit from the outer member, and if the engaging member is located on the outer member, the releasing longitudinal slot may provide a path for the engaging member to exit from the inner member). The releasing lateral slot and releasing longitudinal slot may thus allow the inner member to slide out from the outer member in the same longitudinal direction in which the inner member entered the outer member (e.g., wherein the engaging member first entered the lengthening slot). Thereby, the inner member may be operable to slide out from engagement with the outer member in either longitudinal direction. Such an arrangement may allow the handle of the present invention to be disassembled from either end, which may be useful if the disassembly from one end is prevented by the tool portion, or a blockage in the lengthening slot, etc.

The engaging member may comprise a shape which is complementary to a shape of the length adjusting slot and a shape of the engaging slots. In some embodiments, the profile of the engaging member may comprise a round shape (e.g., a cylindrical extension having a flat distal surface) which is complementary to a flat-bottomed trough shape of the length adjusting slot and the engaging slots. In other embodiments, the engaging member may comprise a dome shape (e.g., a cylindrical extension having a domed or hemispherical distal surface) which is complementary to a rounded-bottom trough shape of the length adjusting slot and the engaging slots. In yet other embodiments, the engaging member may comprise a polygonal shape (e.g., a cube-shaped extension having a flat distal surface) which is complementary to a flat-bottomed trough shape of the length adjusting slot and the engaging slots. In some embodiments, the polygonal extension member may comprise rounded or beveled corners and edges, and the transition points between the length adjusting slot and the engaging slots (e.g., the corners where the walls of each meet) may each comprise a rounded or beveled corner, such that a user may more easily find and engage the engaging slots with the engaging member while adjusting the length of the handle.

The present invention may further comprise an adjustable stop, the stop blocking the engaging member from progressing through a slot of the handle when in a first position, and allowing the engaging member to pass through the slot when the stop is in a second position. The stop may comprise any mechanism operable to prevent the passage of the engaging member through a slot of the present invention. In some embodiments, the stop may comprise a threaded member operable to thread into a threaded passage in the outer member such that when an outer end of the stop is flush with the outer surface of the outer member, the inner end of the stop extends into the releasing longitudinal slot (e.g., a small bolt threading into a bolt hole in the outer member, the bolt having an inverted, polygonal engagement member for receiving the end of a hex wrench). In other embodiments, the stop may comprise a button having a distal end which extends into the releasing longitudinal slot when the button is depressed.

The present invention may further comprise a removable distal cap for sealing a distal end of the outer member. The cap may comprise any device for removably attaching to and sealing a distal end of the outer member. When installed on the distal end of the outer member, the cap may prevent the inner member from passing out of the outer member at the distal end, and may prevent debris, moisture, and other contaminants from entering the outer member from the distal end. When the cap is removed from the distal end of the outer member, the distal end may comprise a passage for sliding the inner member into or out of the outer member. The distal cap may comprise an attachment mechanism for attaching to the distal end of the outer member. In some embodiments, the attachment mechanism may comprise an outer threading having a shape complementary to a threading on an inner surface of the outer member. In other embodiments, the attachment mechanism may comprise at least one of a latch, a clamp, a clip, a lip operable to press-fit into a depression in the inner surface of the outer member, and another similar attachment mechanism.

The engaging member may comprise an increased diameter or width as compared to conventional systems (e.g., in a range from about ⅛ to about ½, of a width of the inner member, and all fractions therebetween) and a high-strength material (e.g., steel, titanium, another metal alloy, graphene, carbon fiber, at the like). In some embodiments, the diameter or width of the engaging member may comprise at least one of about 3/16, about ¼, about 5/16, about ⅓, about 7/16, or about ½ of a width of the inner member. In other embodiments, the current invention may comprise a plurality of engaging members arranged in series along the length of the handle for simultaneous engagement with a plurality of engaging slots. Each of these aspects may provide increased strength to the present invention, and be able to resist breaking or disengagement while under a greater level of force (e.g., levering force as with wrenching, or longitudinal compressive force as with a table leg) than that of conventional systems. The present system may therefor be utilized for heavy-duty jobs such the work performed by semi-truck mechanics, high-rise building framing, supporting heavier weight on fold-out tables, and the like.

In a preferred configuration, the adjustable length handle also has a ring-shaped sealing plate at a first end of the interior channel. The sealing plate has an aperture that allows the outer surface of the first handle member to pass through the sealing plate, but prevents passage of the portion of the first handle member having the engaging member. In addition to keeping the first handle member in the channel, the sealing plate prevents grease, dirt, debris or other materials from getting inside the channel where the material could interfere with the operation of the adjusting mechanism. In some embodiments, the aperture may comprise a sealing member for contacting an outer surface of the inner member. In some embodiments, the sealing member may comprise a gasket or grommet made from a flexible material, the sealing member being operable to provide a tight grip around the outer surface of the inner member without preventing adjustment of a length of the handle. In another embodiment, a brush-like component can be placed in the aperture of the sealing plate to scrape any grease, dirt, debris or other material off the outer surface of the first handle member as it passes into the channel of the second handle member. In other embodiments, the sealing plate may comprise both a sealing member and a brush-like component acting in series. In either embodiment, the sealing plate can be removably connected to the second handle member.

In other embodiments, the new handle can have multiple engaging members on the outer surface of the first handle member, with each engaging member being configured to be received in an engaging slot to provide additional strength when higher torque loads are anticipated. In yet another embodiment, the components of the adjusting mechanism can be switched between the two handle members. In this embodiment, the second handle member can have the engaging member extending into the channel and the outer surface of the first handle member can have the length adjusting slot and engaging slots.

Accordingly, the primary object of the present invention is to provide a new adjustable length handle that has the advantages set forth above and which overcomes the various disadvantages and limitations which are associated with presently available adjustable length handles.

It is an important object of the present invention to provide a new adjustable length handle that is specifically structured and arranged to allow a person to quickly, easily and effectively adjust the length of a handle that is integral with or attached to the work portion of a tool so that the person may be able to accomplish his or her work objective, which may be applying torque to a work object.

An important aspect of the present invention is that it provides a new adjustable length handle that accomplishes the objectives set forth above and elsewhere in the present disclosure.

Another important aspect of the present invention is that it provides an adjustable length handle that is structured and arranged to allow a person to easily, quickly and effectively shorten or lengthen the handle of a tool so that he or she may more efficiently accomplish his or her work objective.

Another important aspect of the present invention is that it provides an adjustable length handle that is structured and arranged to allow a person to easily and quickly change the length of the handle as he or she deems it necessary or beneficial to accomplish a work objective, such as applying torque to a nut, bolt or other work object.

Another important aspect of the present invention is that it provides an adjustable length handle that is structured and arranged to be integrally formed with or attached to, including removably attached, the work portion of a tool.

Another important aspect of the present invention is that it provides an adjustable length handle that is adaptable for use with a wide variety of different types of tools, including ratchets, wrenches, breaker bars and like tools that are or may be utilized to apply torque to a work object, including nuts, bolts and the like.

Another important aspect of the present invention is that it provides an adjustable length handle that can be manufactured out of a wide range of materials and which is adaptable for being manufactured in a manner that can produce a wide range of different length handles, whether the handle will be relatively short or very long, depending on the anticipated needs of the user.

Another important aspect of the present invention is that it provides an adjustable length handle that is structured and arranged to reduce the likelihood that grease, dirt and other materials and/or contact with other objects will interfere with the ability of the user to easily and quickly adjust the handle length as may be needed or beneficial for the user to accomplish a work objective.

Another important aspect of the present invention is that it provides an adjustable length handle having an inner handle member, a tubular shaped outer handle member and an attachment mechanism, with the attachment mechanism comprising an outwardly extending projection on the inner handle member that is moveably received in a longitudinal slot in an inner surface of an interior channel of the outer handle member to allow the handle to move in a longitudinal direction between a retracted position and an extended position and which moves from the longitudinal slot into one of a plurality of connected lateral slots when one of the handle members are rotated relative to the other handle member to fix the position of the two handle members relative to each other and, therefore, the overall length of the adjustable length handle.

Yet another important aspect of the present invention is that it provides an adjustable length handle that is relatively inexpensive to manufacture.

As will be explained in greater detail by reference to the attached figures and the description of the preferred embodiments which follow, the above and other objects and aspects are accomplished or provided by the present invention. As set forth herein and will be readily appreciated by those skilled in the art, the present invention resides in the novel features of form, construction, mode of operation and/or combination of processes presently described and understood by the claims. The drawings and the description of the invention which follows in the Detailed Description are presented for purposes of illustrating one or more of the preferred embodiments of the present invention and are not intended to be exhaustive or limiting of the invention. The scope of the invention is only limited by the claims which follow after the discussion.

The above-described objects, advantages and features of the invention, together with the organization and manner of operation thereof, will become apparent from the following detailed description when taken in conjunction with the accompanying drawings, wherein like elements have like numerals throughout the several drawings described herein. Further benefits and other advantages of the present invention will become readily apparent from the detailed description of the preferred embodiments.

DETAILED DESCRIPTION

Reference will now be made in detail to certain embodiments of the invention, examples of which are illustrated in the accompanying drawings. While the invention will be described in reference to these embodiments, it will be understood that they are not intended to limit the invention. To the contrary, the invention is intended to cover alternatives, modifications, and equivalents that are included within the spirit and scope of the invention. In the following disclosure, specific details are given to provide a thorough understanding of the invention. However, it will be apparent to one skilled in the art that the present invention may be practiced without all of the specific details provided.

With reference to the figures where like elements have been given like numerical designations to facilitate the reader's understanding of the present invention, the preferred embodiments of the present invention are set forth below. The enclosed figures are illustrative of several potential preferred embodiments and, therefore, are included to represent several different ways of configuring the present invention. Although specific components, materials, configurations and uses are illustrated, it should be understood that a number of variations to the components and to the configuration of those components described herein and shown in the accompanying figures can be made without changing the scope and function of the invention set forth herein. For instance, although the description and figures included herewith generally describe and show particular materials, shapes and configurations for the various components of the new adjustable length handle of the present invention, as well as an example of a tool with which the new adjustable length handle may be utilized, those who are skilled in the art will readily appreciate that the present invention is not so limited. In addition, the exemplary embodiments of the new adjustable length handle are shown and described herein with only those components that are required to disclose the present invention. As such, it may be possible or even likely that some of the necessary elements for attaching and using the present invention are not shown or necessarily described below, but which are well known to persons who are skilled in the relevant art. As will be readily appreciated by such persons, the various elements of the present invention that are described below may take on any form consistent with forms that are readily realized by a person of ordinary skill in the art having knowledge of handles and tools that use such handles.

Figure 1:
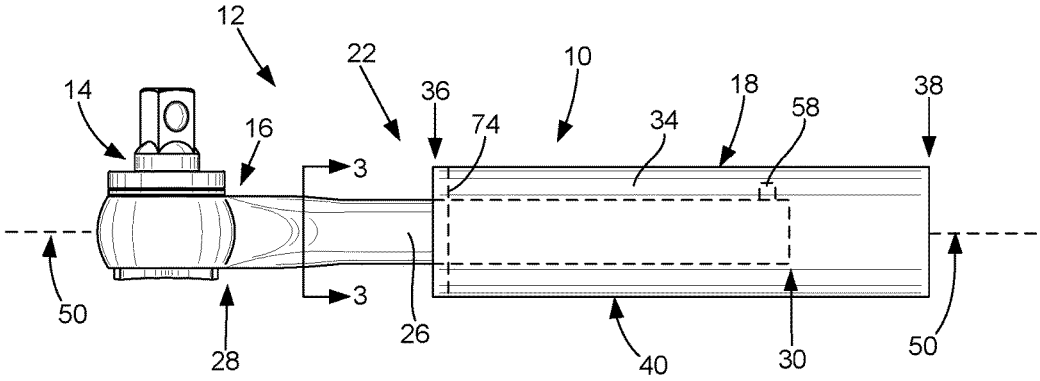
FIG. 1 is a side view of a tool having an adjustable length handle that is configured according to a first embodiment of the present invention, with the new handle shown in its retracted position and integrally formed with a work portion of the tool.
Figure 2:
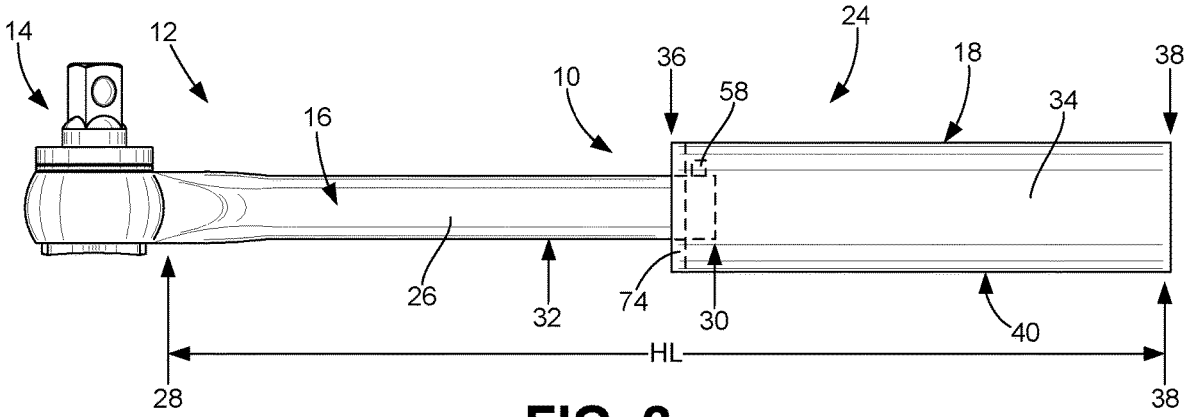
FIG. 2 is a side view of the tool of FIG. 1 shown with the adjustable length handle in its extended position.

An adjustable length handle that is configured pursuant to one or more of the preferred embodiments of the present invention is referred to generally as in FIGS. 1-6, 9-13 and 16. As set forth in detail below, the new adjustable length handle 10 of the present invention is structured and arranged to be attached to or integral with a tool 12 that may be utilized by a person to accomplish a wide variety of different work objectives, including those that require the user to apply torque to a work object, such as a nut, bolt or the like. As well known in the art, the tool 12 has a work portion 14 that is structured and arranged to accomplish a particular work objective. For applying torque, the work portion 14 may be the head of a ratchet (as shown in FIGS. 1 and 2), wrench, breaker bar or the like to form the desired tool 12 (i.e., the ratchet). Alternatively, work portion 14 may be the head of a brush, mop, broom or the like to form a tool 12, such as a brush, mop or broom. The ratchet 12 shown in FIGS. 1 and 2 is provided for exemplary purposes only and is not intended to limit the present invention in any manner. In fact, for purposes of the present invention, the work portion 14 may be of any type of functional or work component that is configured to form any type of tool 12, the use of which may or is likely to benefit from use with the adjustable length handle 10 of the present invention. As will be readily appreciated by persons who are skilled in the art, the new adjustable length handle 10 may be integrally formed with (as shown with regard to the adjustable length handle 10 of FIGS. 1 and 2) or fixedly or re movably attached to (as shown with regard to the adjustable length handle 10 of FIG. 16) a work portion 14 to form a tool 12 that can be beneficially utilized by a person who desires to more efficiently and effectively accomplish any type of work objective where changing the length of the tool 12 is necessary or beneficial.

The adjustable length handle 10 (hereinafter, also referred to as "adjustable handle" or just "handle") generally comprises a first or inner handle member 16, a second or outer handle member 18 and an adjusting mechanism 20 that are cooperatively structured and arranged so the first handle member 16 and second handle member 18 are telescopically configured so as to move between a retracted position 22 and an extended position 24, as respectively shown with regard to FIGS. 1 and 2. The first handle member 16 has a handle body 26 with a first or left end 28, a second or right end 30 and an outer surface 32. The second handle member 18 has a handle body 34 with a first or left end 36, a second or right end 38 and an outer surface 40. The terms "left" and "right" are utilized with regard to the tool 12 in the horizontal position shown in FIGS. 1 and 2.

Figure 4:
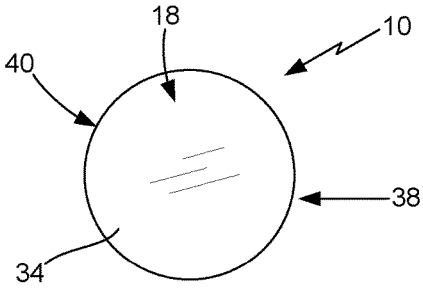
FIG. 4 is a second or right end view of the tool of FIG. 3.
Figure 5:
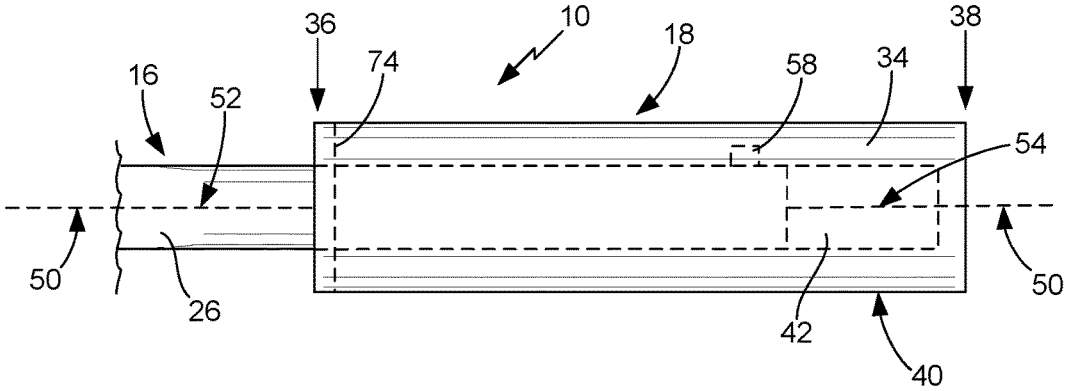
FIG. 5 is a partial side view of the adjustable length handle of FIG. 1.
Figure 6:
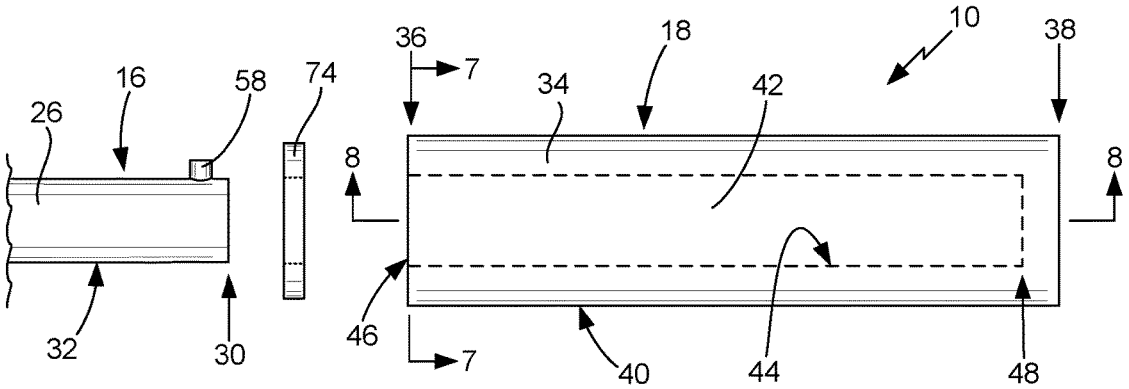
FIG. 6 is an exploded side view of the adjustable length handle of FIG. 5.
Figure 7:
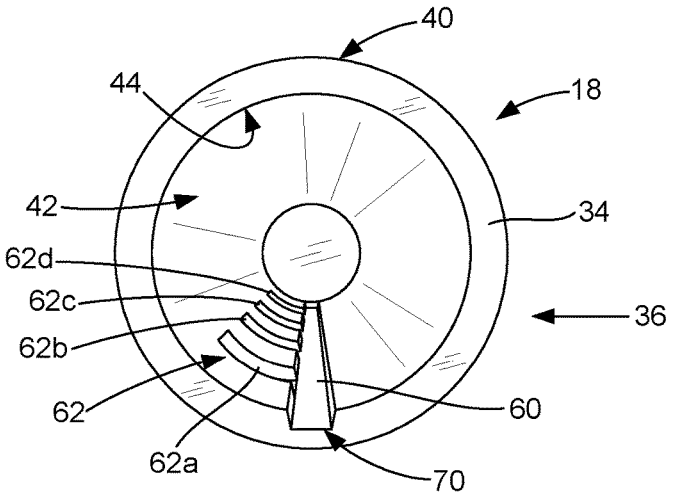
FIG. 7 is a first or left end view of the second/outer handle member of FIG. 6 showing the longitudinally disposed length adjusting slot and three laterally disposed engaging slots.
Figure 8:
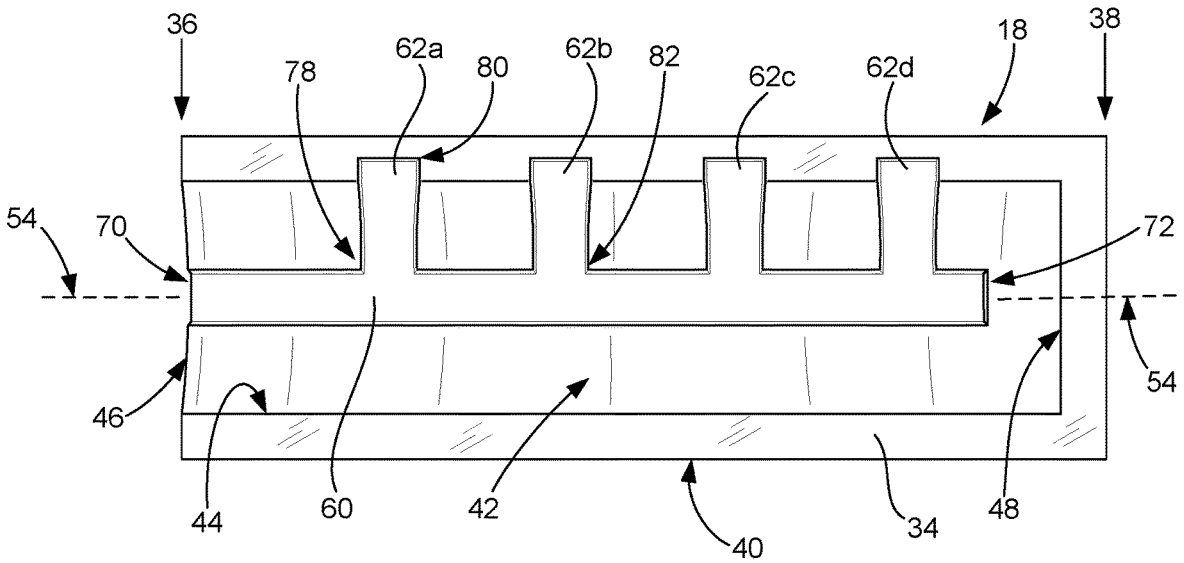
FIG. 8 is a cross-sectional side view of the second/outer handle member of FIG. 6 taken through lines 8-8 of FIG. 6 showing the length adjusting slot and engaging slots thereof.
Figure 9:
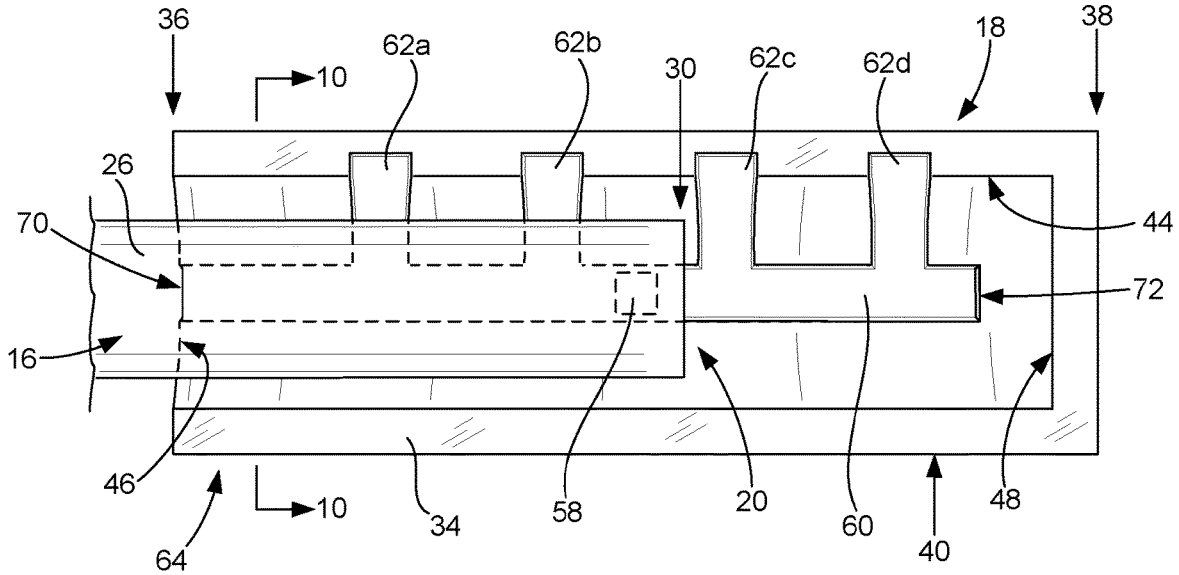
FIG. 9 is a side view of the second/outer handle member of FIG. 8 having a portion of the first/inner handle member disposed inside the channel of the second/outer handle member, with the adjustable length handle shown in its non-engaged condition having the engaging member moveably disposed in the length adjusting slot.
Figure 11:
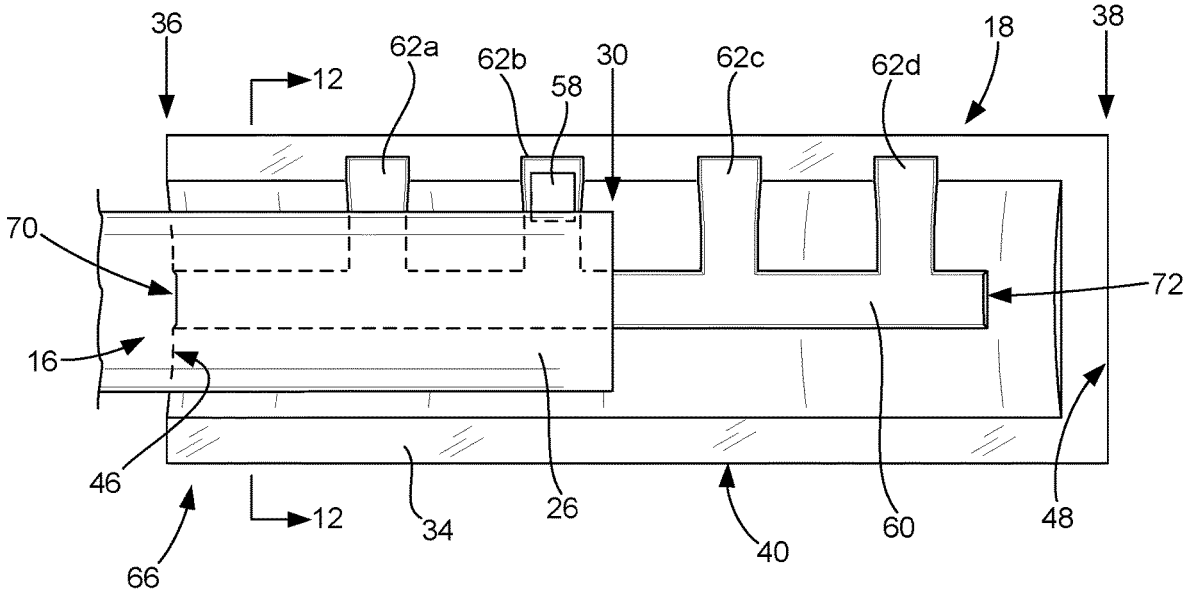
FIG. 11 is a side view of the second/outer handle member of FIG. 8 having a portion of the first/inner handle member disposed inside the channel of the second/outer handle member, with the adjustable length handle shown in its engaged condition having the engaging member in one of the engaging slots.

In the embodiments shown in the figures, each of the first handle member 16 and second handle member 18 of handle 10 are cooperatively sized and configured such that the second handle member 18 moves over a portion of first handle member 16 (or put another way, a portion of first handle member 16 moves in and out of second handle member 18). As such, in this embodiment, the second handle member 18 is tubular shaped with an interior channel 42 defining an inner surface 42, as best shown in FIGS. 8, 9 and 11, that is disposed in the handle body 34 of the second handle member 18. The interior channel 42 defines an open first end 36. In the embodiment shown in the figures, a first end 46 of the interior channel 42 of second handle member 18 corresponds to the first end 36 of the second handle member 18 and a second end 48 of the interior channel 42 is in spaced apart relation to the second end 38 of second handle member 18, as best shown in FIGS. 8, 9 and 11. In this embodiment, the second handle member 18 has a closed second end 38, as also shown in FIG. 4. In alternative embodiments, the interior channel 42 may extend completely through the second handle member 18 such that the second end 48 of the interior channel 42 corresponds to the second end 38 of the second handle member 18. Though not shown in the figures, a person skilled in the art will appreciate that in such an embodiment, a portion of the handle body 26 near or toward the second end 30 of the first handle member 16 may be able to extend beyond the second end 38 of the handle body 34 of the second handle member 18 (i.e., to the right of the second end 38 of the tool shown in FIGS. 1 and 2) when the handle 10 is in its retracted position 22. This may or may not have benefits to the use of a tool 12 having the new handle 10.

Figure 13:
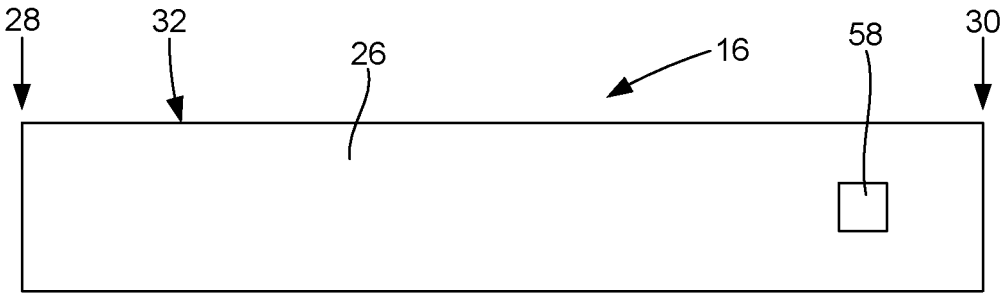
FIG. 13 is a top view of the inner handle member of FIG. 1 showing the engaging member on the outer surface thereof.

The adjusting mechanism 20 of the new handle 10 is structured and arranged to allow the first handle member 16 and second handle member 18 to move relative to each other in a telescoping manner along the longitudinal axis 50 (shown in FIGS. 1 and 5) between the retracted position 22 and extended position 24, shown in FIGS. 1 and 2. In the embodiments shown in the figures, the handle 10 has a round cross-section. In these embodiments, the first handle member 16 has a longitudinal axis 52 and the second handle member 18 has a longitudinal axis 54, as best shown in FIGS. 8 and 13, and the longitudinal axis 50 of the handle 10 is in alignment with the longitudinal axis 52 of the first handle member 16 and with the longitudinal axis 54 of the second handle member 18. In other configurations of handle 10, the axes 50, 52 and 54 may not necessarily be in alignment.

The adjusting mechanism 20 of the new handle is structured and arranged to allow the first handle member 16 and the second handle member 18 to move relative to each other to shorten or increase the handle length, shown as HL in FIG. 2, as necessary or desired by the user of the tool 12 with which the handle 10 is associated. As will be readily appreciated by persons skilled in the art, the handle length HL may be selected, depending on the configuration of the adjusting mechanism 20, to be at or between the retracted position 22 and the extended position 24, such as the partially extended position 56 shown in FIG. 11. As set forth in more detail below, the adjusting mechanism 20 may be configured to provide one or more partially extended positions 56.

Figure 10:
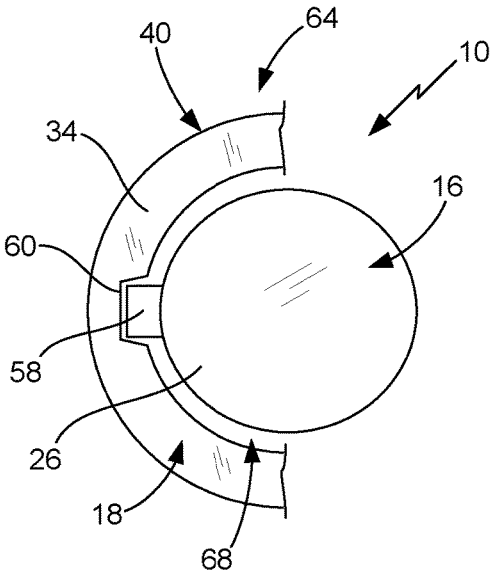
FIG. 10 is a cross-sectional end view of the second/handle member and inner handle member of FIG. 9 taken through the lines 10-10 of FIG. 9.
Figure 12:
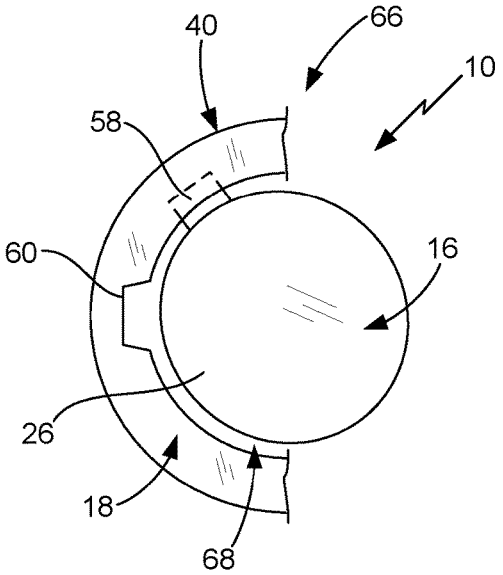
FIG. 12 is a cross-sectional end view of the second/handle member and inner handle member of FIG. 11 taken through the lines 12-12 of FIG. 11.
Figure 21:
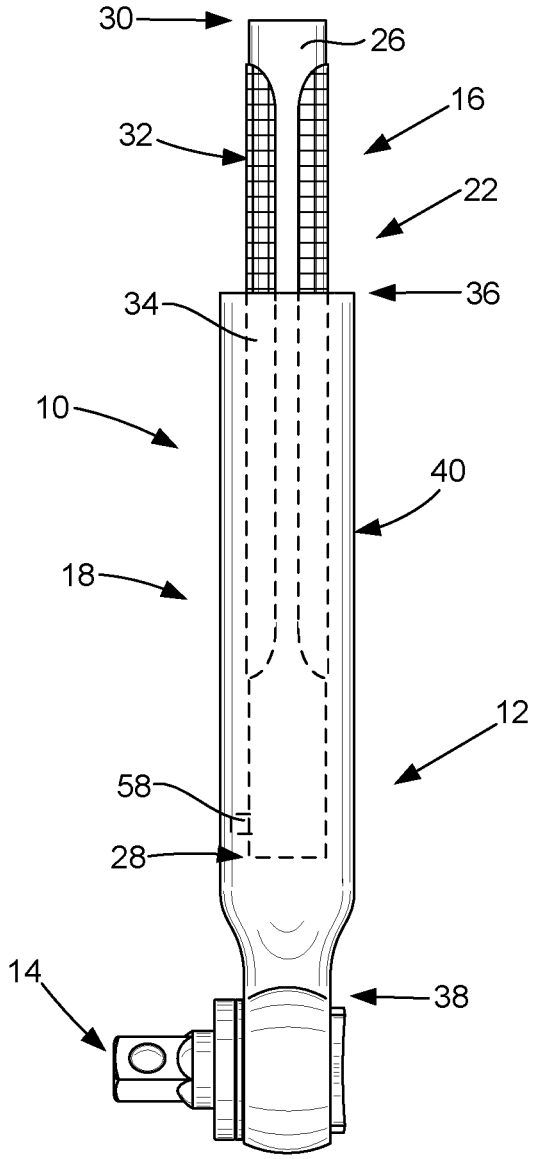
FIG. 21 is a side view of a tool having an adjustable length handle that is configured according to a fourth embodiment of the present invention, with the tubular shaped second/outer handle member being connected to the work portion of the tool and the first/inner handle member configured to move in and out the interior channel of the first handle member and the adjustable length handle shown in the retracted position.
Figure 22:
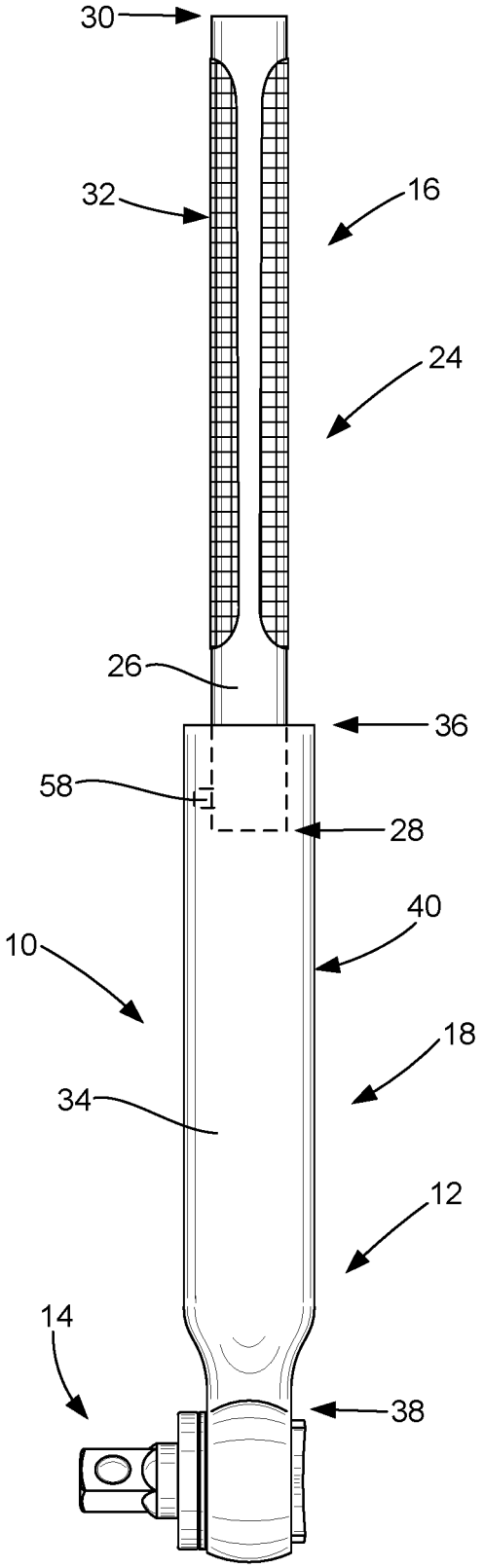
FIG. 22 is a side view of the tool of FIG. 21 with the adjustable length handle shown in its extended position.

The adjusting mechanism 20 of the new handle 10 comprises at least one outwardly extending engaging member 58 that is sized and configured to be slidably received in and move along a longitudinally disposed length adjusting slot 60 and into and out of one or more laterally disposed engaging slots 62, as best shown in FIGS. 7-13. As set forth in more detail below, the engaging member 58 moves longitudinally along the length adjusting slot 60 to allow the user to move either the first handle member 16 relative to the second handle member 18 or the second handle member relative 18 to the first handle member 16 (depending on which handle member 16/18 is attached to or integral with the tool portion 14) and to also move into and out of the engaging slots 62 upon rotation of the first handle member 16 or the second handle member 18 (depending on which handle member 16/18 is attached to or integral with the tool portion 14, as shown in FIGS. 1-2 relative to FIGS. 21-22) to temporarily fix the first handle member 16 and the second handle member 18 relative to the other so as to establish a handle length HL that allows the user to accomplish, or at least more efficiently accomplish, the work objective. As set forth below, when engaging member 58 is positioned in the length adjusting slot 60 (by the user rotating either the first 16 or second 18 handle member), the handle 10 is in its moving or disengaged condition 64, as shown in FIGS. 9-10, and when engaging member 58 is in one of the engaging slots 62, the handle 10 is in its fixed or engaged condition 66, as shown in FIGS. 11-12.

The outwardly extending engaging member 58 extends outward from the outer surface 32 of the handle body 26 of the first handle member 16, as best shown in FIGS. 1-2, 5-6, 10 and 12-13. As best shown in FIGS. 10 and 12, the engaging member 58 extends outwardly from the outer surface 32 of the handle body 26 a sufficient distance to bridge the gap 68 between the outer surface 32 of the first handle member 16 and the inner surface 44 of the second handle member 18 and sufficiently extend into either the length adjusting slot 60 or one of the engaging slots 62 to accomplish the moving or engaging objectives for the handle 10 of the present invention. More specifically, the engaging member 58 must extend far enough into the length adjusting slot 60 and into the engaging slots 62 such that the engaging member 58 will stay in the slots 60/62 to maintain the handle 10 in either its disengaged condition 64 or its engaged condition 66 to, respectively, allow the user to easily move the handle members 16/18 relative to each other or to fix the handle length HL. As will be readily appreciated by persons skilled in the art, the exact amount which the engaging member 58 will extend above the outer surface 32 of the handle body 26 of the first handle member 16 is likely to depend on factors such as the amount of wall thickness available in the second handle member 18 and the amount of torque or other force to which the handle 10 is likely to be subjected to during use thereof. In addition, although the engaging member 58 and slots 60/62 can have different sizes and shapes, the engaging member 58 and slots 60/62 will need to be sized and configured in cooperative arrangement so the engaging member 58 will fit into and be able to move along the length adjusting slot 60 and engaging slots 62. In the embodiment shown in the figures, the engaging member 58 is square shaped and each of the length adjusting slot 60 and the engaging slots 62 are rectangular shaped with a cross-section that is just slightly larger than the square shaped engaging member 58 so the engaging member 58 will fit into and be able to move along the slots 60/62. As will also be readily appreciated by persons skilled in the art, although the engaging member 58 and slots 60/62 must be cooperatively configured, there are various different shapes and sizes that can be utilized for the engaging member 58 and the slots 60/62, including a round engaging member 58 and curved slots 60/62 and the like.

The longitudinally disposed length adjusting slot 60 has a first end 70 and a second end 72, as best shown in FIGS. 8, 9 and 11. In the embodiment 20 shown in the figures, the first end 70 of the length adjusting slot 60 is at the first end 36 of the second handle member 18, which is also where the first end 46 of the interior channel 42 is located. The second end 72 of the length adjusting slot 60 is toward the second end 48 of the interior channel 42, which is towards the second end 38 of the second handle member 18. Although the length adjusting slot 60 does not need to extend to the first end 36 of the second handle member and first end 46 of the interior channel 42, having the length adjusting slot 60 open at these ends 36/46 will help with the manufacturing process by allowing the first handle member 16, having engaging member 58 thereon, to be positioned inside the second handle member 18.

Figure 3:
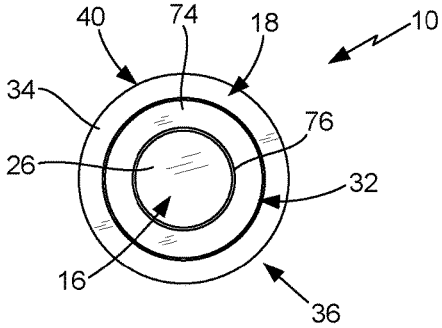
FIG. 3 is a slightly enlarged cross-sectional view of the tool of FIG. 1 taken through lines 3-3 of FIG. 1.

In a preferred configuration, a ring-shaped sealing plate 74, having an aperture 76 therethrough, can be utilized to close the interior channel 42 at its first end 46, as shown in FIGS. 1-6, when the first handle member 16 being moveably received through the aperture 76, as best shown in FIG. 3 (without the first handle member 16, the interior channel 42 would be open through the aperture 76). The aperture 76, which is positioned at approximately the center of the sealing plate 74, is sized and configured to allow the handle body 26 of the first handle member 16 to move therethrough, but prevent the portion of the first handle member 16 having the engaging member 58 from passing from the interior channel 42 out past the first end 36, to secure the engaging member 58 inside the interior channel 42 of the second handle member 18. In addition to keeping that portion of the first handle member 16 inside the interior channel 42, the sealing plate 74 substantially closes off the first end 46 of interior channel 42 to significantly reduce the likelihood that grease, dirt, debris or other materials will get into the interior channel 42 or one of the slots 60/62. Keeping these materials out of interior channel 42 significantly reduces the likelihood that such materials will interfere with the movement of the first handle member 16 relative to the second handle member 18 or the movement of the engaging member 58 in or along the slots 60/62. In one embodiment, the second handle member 18 and ring-shaped sealing plate 74 can be cooperatively configured such that the sealing plate 74 can be removed from the second handle member 18 by the user if he or she wants or needs to clean the interior channel 42 and/or slots 60/62. A set screw or like connector can be utilized through one side of the handle body 34 to engage the sealing plate 74 and hold it in place at the second end 38 of the handle body 34 of the second handle member 18. The configuration and use of a screw or other connector to removably hold a ring or ring-like member inside a tubular member are generally well known in the relevant art. In another embodiment, the inner edge of the aperture 76 of ring-like sealing plate 74 can have brush or brush-like components that extend generally inward to the aperture 76 that are configured to scrape or otherwise remove any grease, dirt, debris or other materials off of the outer surface 32 of the handle body 26 of the first handle member 16 before the it enters the interior channel 42.

Each of the engaging slots 62 are passably connected to the length adjusting slot 60 so the engaging member 58 can selectively move between the length adjusting slot 60 and one of the engaging slots 62 with relative ease as the handle 10 moves between its disengaged condition 64 and disengaged condition 66. In FIGS. 7-9 and 11, the adjusting mechanism 20 is shown with four engaging slots 62, shown as the first engaging slot 62*a*, second engaging slot 62*b*, third engaging slot 62*c* and fourth engaging slot 62*d*. Each of the engaging slots 62 have a first end 78 that is passably connected to the length adjusting slot 60 and a second or distal end 80 at which the engaging slot 62 terminates, as best shown in FIG. 8. In the preferred configuration, each of the engaging slots 62 are sized and configured substantially the same (i.e., very minor if any size and shape difference) as length adjusting slot 60 and the intersection, shown as slot intersection 82 in FIG. 8, where the first end 78 of an engaging slot 62 joins the length adjusting slot 60 is smooth to provide a substantially effortless passable transition from the length adjusting slot 60 to the engaging slot 62. In the embodiment shown in the figures, the engaging slots 62 are also rectangular shaped with a cross-section that is just slightly larger than the square shaped engaging member 58 so the engaging member 58 will moveably fit into and move along the slots 62. As will be readily appreciated by persons skilled in the art, although the engaging member 58 and engaging slots 62 must be cooperatively configured, there are various different shapes and sizes that can be utilized for the engaging member 58 and engaging slots 62, such as having a round engaging member 58 and curved slots 60/62 or the like. The engaging slots 62 can have any length. In one embodiment, the length of the engaging slots 62 is selected such that the user rotates one of the handle members 16/18 a one-fourth or one-half turn before the engaging member 58 moves from the length adjusting slot 60 to the second end 80 of the selected engaging slot 62. As will be readily appreciated by persons skilled in the art, the longer lengths engaging slots 62 are likely to provide improved engagement of the engagement member 58 in the engaging slot 62.

Figure 16:
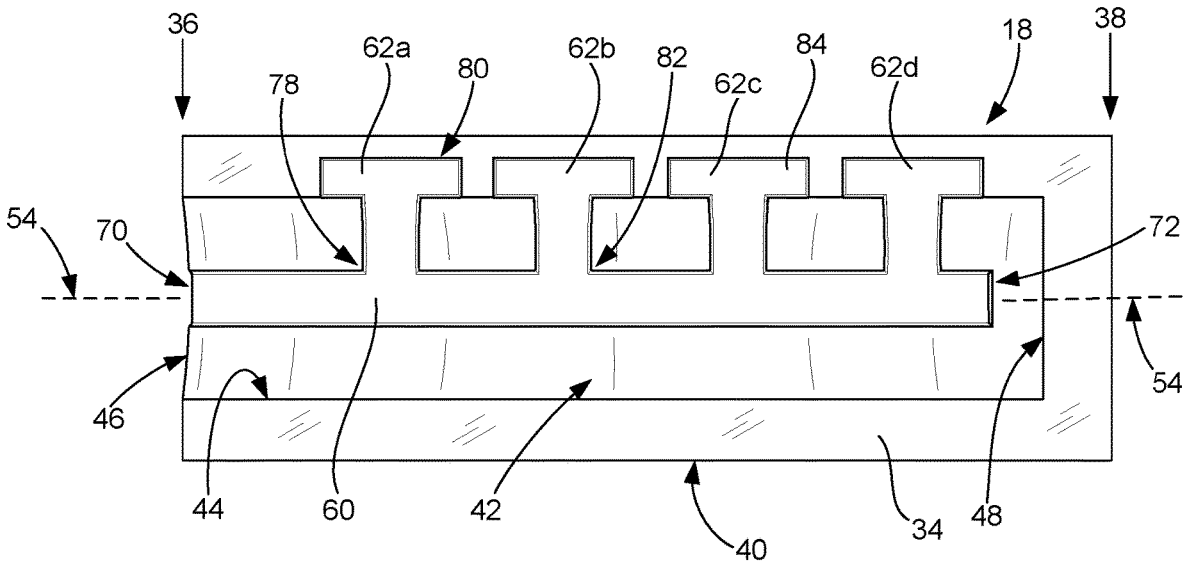
FIG. 16 is a cross-sectional side view of an alternative embodiment of the second/outer handle member showing the use of a secondary shaped section at the second or distal end of each of the engaging slots.

In the alternative embodiment of FIG. 16, the engaging slots 62 can be generally L-shaped or T-shaped, with the secondary shaped section (shown as 84 in FIG. 16) being at or near each of the second ends 80 of the engaging slots 62, to further secure the engaging member 58 in the engaging slots 62, particularly where it is anticipated that the handle 10 will be subject to relatively high torque and/or other forces. In one configuration of this embodiment, the secondary shaped section 84 is longitudinally disposed such that the secondary shaped section 84 is substantially parallel to the length adjusting slot 60, as shown in FIG. 16. In other configurations, the secondary shaped section 84 may be at an angle other than 90° relative to the associated engaging slot 62. The secondary shaped section 84 should be sized and shaped the same as the engaging slot 62 and have a length that is sufficient to securely receive the engaging member 58 therein, such as being at least as long as the engaging member 58 is wide. With the engaging member 58 received in the secondary shaped section 84, it is anticipated that there will be less likelihood of the engaging member 58 inadvertently exiting an engaging slot 62 when the tool 12 associated with the handle 10 is being utilized.

Figure 14:
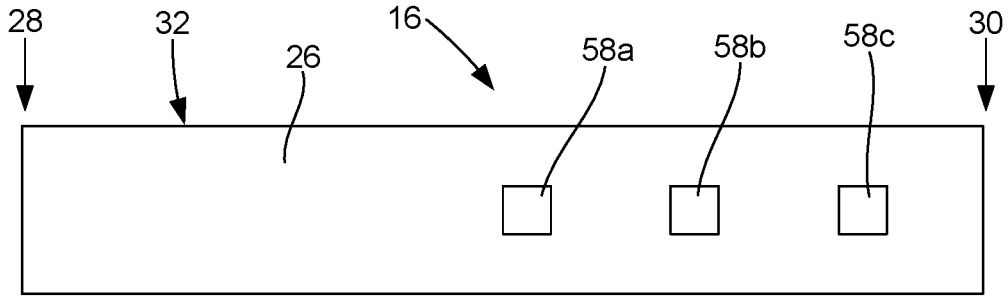
FIG. 14 is a top view of an inner handle member that is configured according to a second embodiment of the present invention showing use of multiple engaging members on the outer surface thereof.
Figure 15:
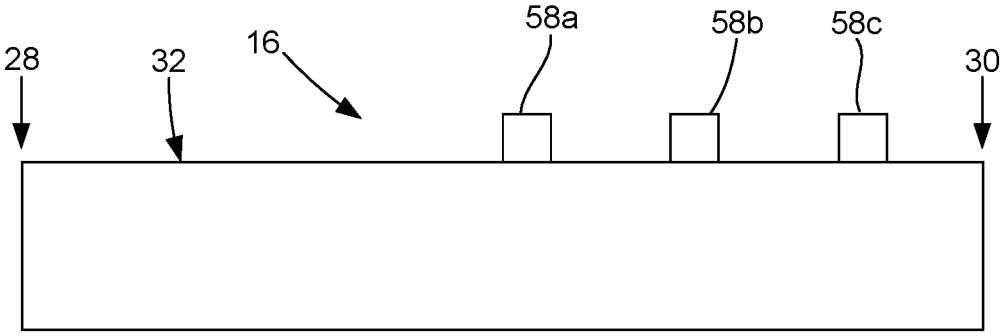
FIG. 15 is a side view of the inner handle member of FIG. 14.

In another alternative embodiment of the handle 10 of the present invention, the adjusting mechanism 20 thereof may have more than one engaging member 58, such as the three engaging members 58*a*, 58*b* and 58*c* shown in FIGS. 14 and 15, extending outward from the outer surface 32 of the handle body 26 of the first handle member 16. In this embodiment, the handle 10 is configured such that all three of the engaging members 58*a*/58*b*/58*c* will move into engaging slots 62 at the same time. With more than one engaging member 58 being in an engaging slot 62, the first handle member 16 will be more securely joined to the second handle member 18. Having multiple engaging members 58 inside the engaging slots 62 is likely to be particularly useful where it is anticipated that the handle 10 will be subject to relatively high torque and/or other forces during use of the tool 12 with which the handle 10 is associated. As described above for the single engaging member 58, each of the multiple engaging members 58*a*/58*b*/58*c* are cooperatively sized and configured with the slots 60/62 so as to move along the length adjusting slot 60 and in and out of the engaging slots 62. As will be readily appreciated by persons skilled in the art, the use of three engaging members 58 is provided for exemplary purposes only, as the handle 10 may have two engaging members 58 or more than three engaging members 58.

The various components of handle 10 can be made out of a variety of different materials, including metal, composites, plastic, fiberglass, wood and the like. Typically, the materials for handle 10 will depend on the anticipated use of the tool 12 with which the handle 10 will be associated. Metal and other relatively stiff and strong materials are likely to be required when for use with torque type of tools 12, such as ratchets, wrenches, breaker bars and the like. In one embodiment, the outer surface 40 of the second handle member 18 is made out of and/or, covered or coated with a material that provides a gripping surface to improve the user's ability to securely hold onto the handle 10 when he or she is using the tool. A variety of other well-known handling and aesthetic modifications for handles may be incorporated into the new handle 10.

Figure 17:
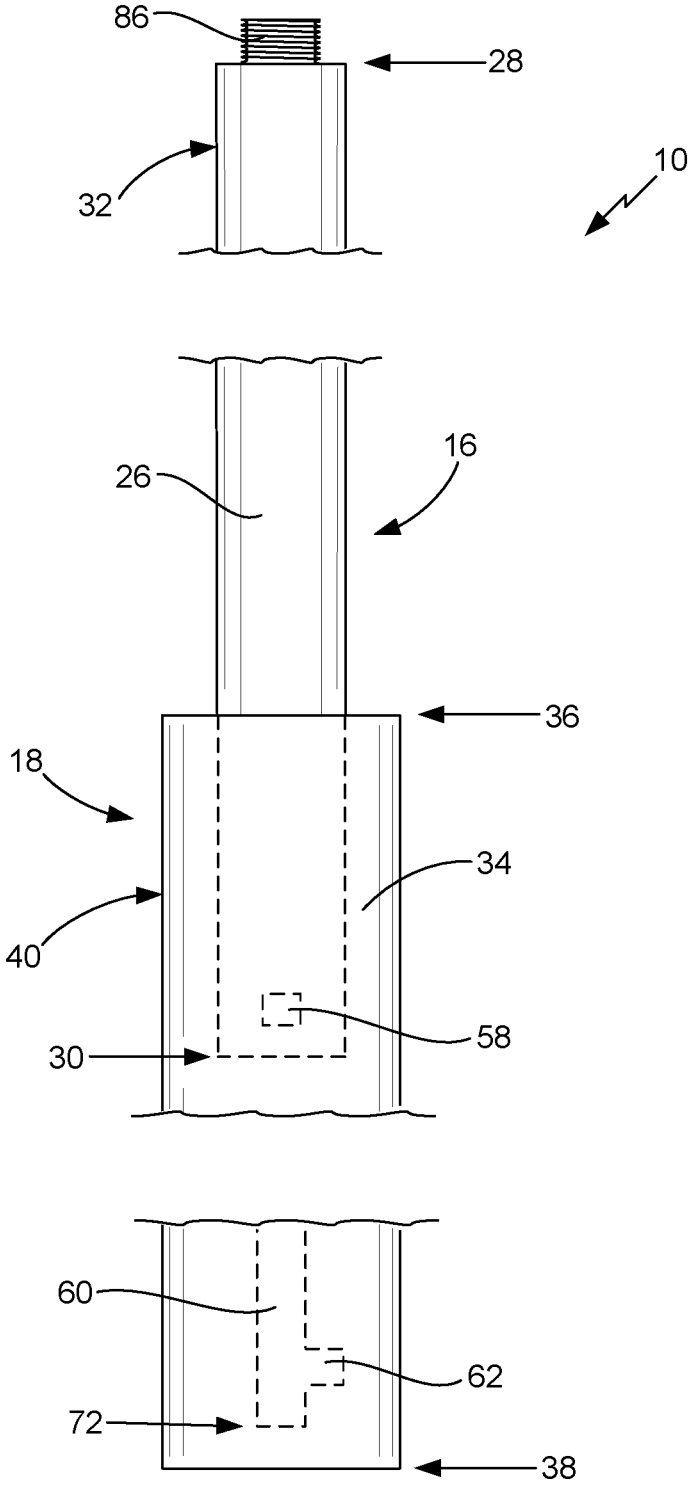
FIG. 17 is a side view of an adjustable length handle member having a threaded work tool connector at the first end of the first/inner tubular member for removably connecting the handle to a work portion to form a tool.
Figure 18:
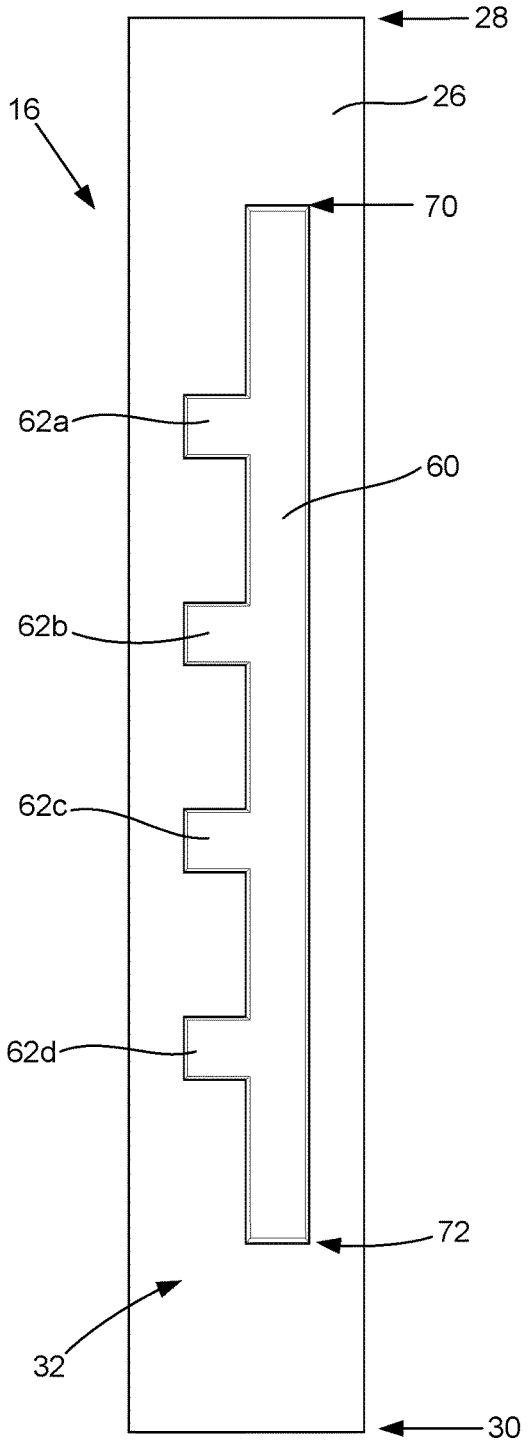
FIG. 18 is a top view of an alternative embodiment of the first handle member showing placement of the length adjusting slot and engaging slots at the outer surface thereof.
Figure 19:
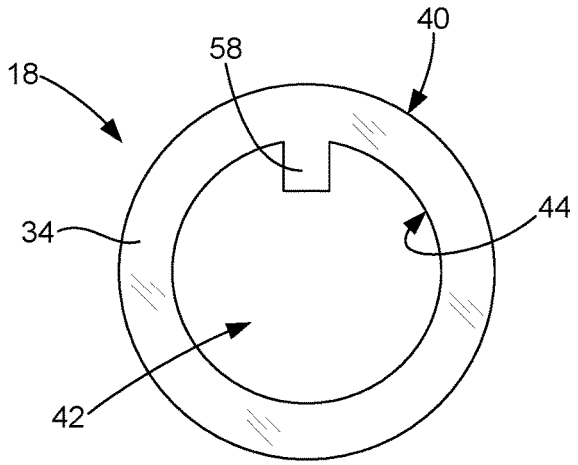
FIG. 19 is an end view of the first end of an alternative embodiment of the second handle member showing the engaging member extending outwardly from the inner surface thereof into the interior channel.
Figure 20:
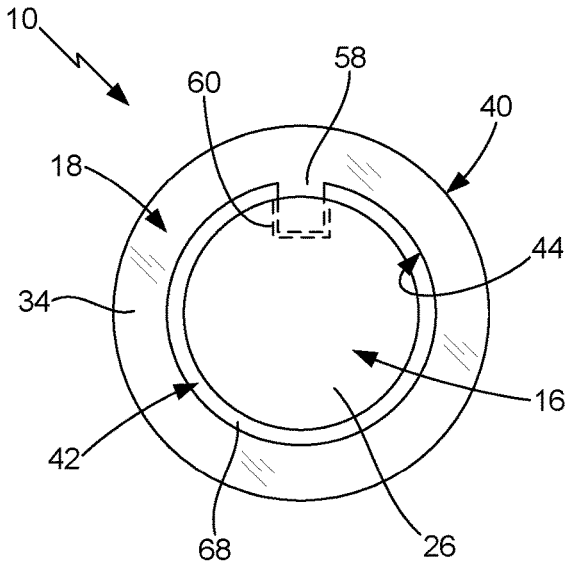
FIG. 20 is a handle configured according to a third embodiment of the present invention, which utilizes the first handle member of FIG. 18 and the second handle member of FIG. 19, showing the engaging member in the length adjusting slot with the handle in its disengaged condition.

The embodiment of FIG. 17 shows a handle 10 that is configured to be removably attached to the work portion 14 of a tool 12. For instance, the handle 10 can be utilized with the head of a mop, brush, broom or the like to form a mop, brush, broom or the like with an adjustable length handle 10 that will allow the user to (as an example) reach higher places than he or she would otherwise be able to with most fixed length handles. To provide for the connection to a work portion 14, the handle 10 has a work tool connector 86 at the first end 28 of the first handle member 16, as shown in FIG. 17. In this embodiment, the work tool connector 86 has external threads that are threadably received in a socket associated with the work portion 14 to form the tool 12 that the user can utilize to accomplish the desired work objective.

In use, the user selects a tool 12 having an adjustable length handle 10 configured according to the present invention attached to or integrally formed with the work portion 14 of the tool 12. As the user is using the tool 12, he or she will move the work portion 14 towards the work object, such as a bolt, nut or the like, to perform the desired work objective, such as tightening or loosening the work object. If the user needs, or otherwise determines it to be beneficial, to shorten or lengthen the handle length HL, he or she will operate the adjusting mechanism 20 of the handle 10 to place the handle 10 in its retracted position 22, extended position 24 or a partially extended position 56 to be able to more efficiently and/or effectively utilize the tool 12. To shorten or lengthen the handle 10, the user rotates (typically) the second handle member 18 to move the engaging member 58 into the length adjusting slot 60, as shown in FIG. 9, and then slides the engaging member 58 in the length adjusting slot 60 by (typically) moving the second handle member 18 relative to the first handle member 16 to obtain the desired handle length HL. Using the second handle member 18, the user then positions one of the engaging slots 62 adjacent the engaging member 58 and rotates the second handle member 18 to slide the engaging member 58 into the nearby engaging slot 62, as shown in FIG. 11, to fix the position of the second handle member 18 relative to the first handle member 16. With the engaging member 58 inside the engaging slot 62 (or, as applicable, the secondary shaped section 84 thereof), the tool 12 has the equivalent of a fixed length handle that is of the handle length HL which is most beneficial to the user. When the user needs to adjust the handle length HL again, he or she merely repeats the above.

The pin and groove arrangement of the adjusting mechanism 20 of the new handle 10 of the present invention has a number of benefits relative to prior art adjustable handles. As will be readily appreciated by persons skilled in the art, the new handle 10 allows the user to easily, quickly and effectively shorten or lengthen the handle length HL anytime he or she needs to or otherwise considers it to be beneficial to complete the work objective. The configuration of the new handle 10 of the present invention will be particularly useful for tools 12 that the user utilizes to apply torque to a work object, such as a bolt, nut or the like. The new handle 10 may be attached to, including removably attached to, or integrally formed with a work portion 14 of a tool 12 to provide the length adjusting features of the new handle 10 to the tool 12. In addition, the configuration of the adjusting mechanism 20 of the handle 10 of the present invention is much less likely to have problems with grease, dirt, debris or other materials interfering with the length-adjusting operation of the new handle 10.

In an alternative configuration of the new handle 10, the second handle member 18 may be connected to the work portion 14 of the tool 12 (instead of the first handle member 16) and the first handle member 16 may move in and out of the second handle member 18, with the user grasping the outer surface 32 of the handle body 26 of the first handle member 16. In another alternative configuration, the various components of the length adjusting mechanism 20 may be switched between the first handle member 16 and the second handle member 18. In such a configuration, the engaging member 18 would extend from the inner surface (or wall) 44 of the handle body 34 of the second handle member 18 into the interior channel 42 and the length adjusting slot 60 and the one or more engaging slots 62 would be cut into the outer surface 32 of the handle body 16 of the first handle member 16. As described with the above embodiments, engaging member 58 and slots 60/62 are cooperatively configured so the engaging member 58 is received in and moves along the length adjusting slot 60 and in and out of the engaging slots 62. Other than the components of the adjusting mechanism 20 being reversed, the handle 10 of this embodiment would operate the same as the handle 10 described above.

Figure 23:
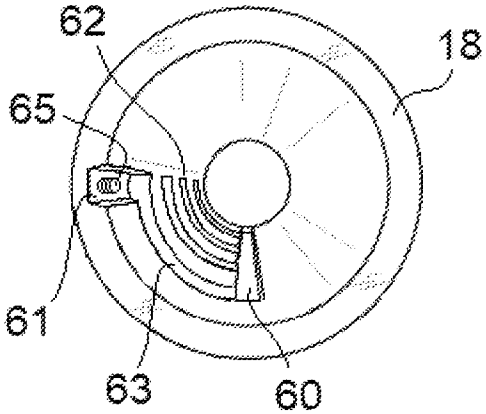
FIG. 23 is an end-on view of an outer handle member, according to an embodiment of the present invention.

As seen in FIG. 23, the engaging slots may comprise a length which represents an increased arc length around the inner or outer handle member, so as to allow for a greater margin of error without the engaging member disengaging from an engaging slot when the user twists his or her wrist while the tool is in use. The engaging slots may each comprise an arc of approximately 90 degrees (e.g., from about 85 degrees to about 95 degrees). The engaging slots of the present invention may thereby prevent accidental disengagement of the engaging member due to a normal flexion of the wrist which may occur while using the handle of the present invention to perform a task. However, a user may still be able to adjust a length of the handle with one hand and without taking the work end away from the work (e.g., without taking the socket off of the bolt), by intentionally twisting the handle.

The adjustable length handle of the present invention may comprise a releasing lateral slot 63, the releasing lateral slot 63 providing a path from the lengthening slot 60 to a releasing longitudinal slot 61. The releasing lateral slot 63 may comprise an orientation and shape similar to the engaging slots 62, and may be arranged at an end of the lengthening slot 60. The releasing longitudinal slot 61 may provide a path which allows the engaging member 58 to exit from the outer member 18. The releasing lateral slot 63 and releasing longitudinal slot 61 may thus allow the inner member 16 to slide out from the outer member 18 in the same longitudinal direction in which the inner member 16 entered the outer member 18 (e.g., wherein the engaging member 58 first entered the lengthening slot 60).

The adjustable length handle of the present invention may further comprise an adjustable stop 65, the stop 65 blocking the engaging member 58 from progressing through the releasing longitudinal slot 61 of the outer member 18 in a first position (see FIG. 23), and allowing the engaging member 58 to pass through the releasing longitudinal slot 61 when the stop 65 is in a second position (e.g., threaded out of the outer member 18, not shown). The stop 65 may comprise a threaded member operable to thread into a threaded passage in the outer member 18, the inner end of the stop 65 extending into the releasing longitudinal slot 61.

Figure 24B:
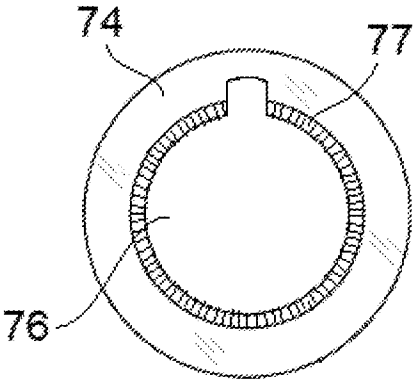
FIGS. 24A and 24B each provide a top-down view of a sealing plate, according to an embodiment of the present invention.
Figure 24A:
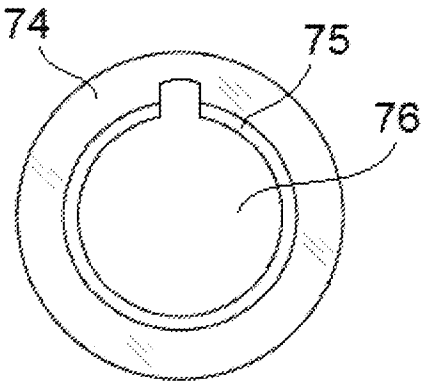

As seen in FIG. 24A, the aperture 76 of the sealing plate 74 may comprise a sealing member 75 for contacting an outer surface of the inner member 16. The sealing member 75 may comprise a grommet made from a flexible material, the sealing member 75 being operable to provide a tight grip around the outer surface of the inner member 16 without preventing adjustment of a length of the handle. As seen in FIG. 24B, in another embodiment, the aperture 76 of the sealing plate 74 may comprise a brush-like component 77 to scrape any grease, dirt, debris or other material off the outer surface of the inner member 16 as it passes into the channel of the outer member 18.

Figure 25:
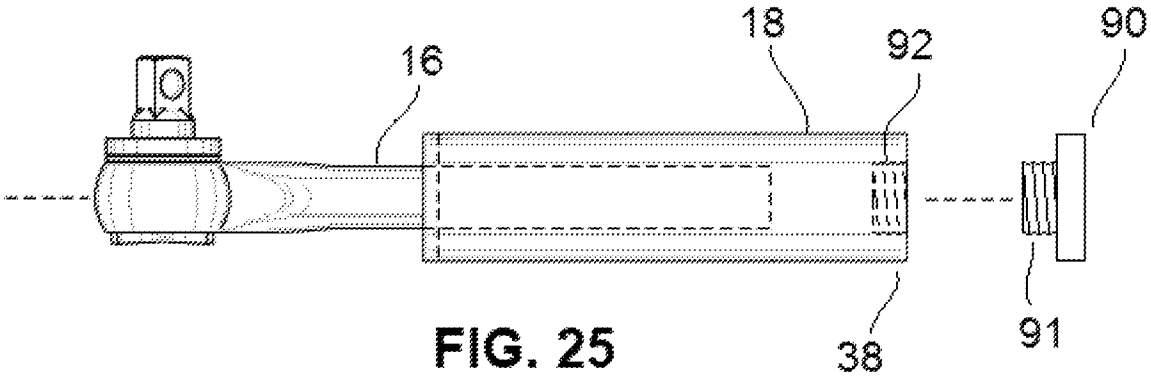
FIG. 25 is a side view of an adjustable length handle, according to an embodiment of the present invention.

As seen in FIG. 25, the adjustable length handle of the present invention may further comprise a removable distal cap 90 for sealing a second end 38 of the outer member 18. When installed on the second end 38 of the outer member 18, the cap 90 may prevent the inner member 16 from passing out of the outer member 18 at the second end 38, and may prevent debris, moisture, and other contaminants from entering the outer member 18 from the second end 38. The distal cap 90 may comprise a threading 91 having a shape complementary to a threading 92 on an inner surface of the outer member 18.

While there are shown and described herein specific forms of the invention, it will be readily apparent to those skilled in the art that the invention is not so limited, but is susceptible to various modifications and rearrangements in design and materials without departing from the spirit and scope of the invention. In particular, it should be noted that the present invention is subject to modification with regard to any dimensional relationships set forth herein and modifications in assembly, materials, size, shape and use. For instance, there are numerous components described herein that can be replaced with equivalent functioning components to accomplish the objectives of the present invention.

What is claimed is:

1. An adjustable length handle, comprising:

a first handle member having a handle body with a first end, a second end and an outer surface;

a second handle member having a handle body, a first end, a second end and an outer surface, one of said first handle member and said second handle member being tubular shaped so as to provide an interior channel that defines an inner surface, the other of said first handle member and said second handle member is moveably received in said interior channel so as to position one of said outer surface of said first handle member and said outer surface of said second handle member is opposing relation to said inner surface;

an adjusting mechanism interconnecting said first handle member and said second handle member at said inner surface of said interior channel and said one of said outer surface of said first handle member and said outer surface of said second handle member, said adjusting mechanism structured and arranged to allow linear movement of one of said first handle member and said second handle member relative to the other of said first handle member and said second handle member along a longitudinal axis of said handle to move said handle between a retracted position and an extended position to select a handle length for said handle and rotational movement of one of said first handle member and said second handle member relative to the other of said first handle member and said second handle member to move said handle between a disengaged condition and an engaged condition to prevent linear movement of said second handle member relative to said first handle member fixedly establish said handle length; and a ring-shaped sealing plate and an adjustable stop at a first end of said interior channel, said sealing plate having an aperture sized and configured to allow said outer surface of said first handle member to pass through said sealing plate and adjustable stop configured to selectively allow the passage of said engaging member through said sealing plate.

2. The adjustable length handle of claim 1, wherein said adjusting mechanism comprises an engaging member at said one of said outer surface of said first handle member and said outer surface of said second handle member, a length adjusting slot longitudinally disposed in said inner surface and one or more engaging slots each comprising a first shaped section laterally disposed in said inner surface so as to be connected to said length adjusting slot at a first end, said engaging member sized and configured to slide along said length adjusting slot when said handle is in said disengaged condition and to rotate into said engaging slots to place said handle in said engaged condition.

3. The adjustable length handle of claim 2 wherein said one or more engaging slots each further comprise an intersecting slot continuous with said engaging slot at a second end of said engaging slot, said intersecting slot is sized and configured to receive said engaging member when said handle is in said engaged condition.

4. The adjustable length handle of claim 2, wherein each of said engaging slots has a first end connected to said length adjusting slot and a second end distally disposed from said length adjusting slot, said engaging member cooperatively sized and configured with each of said length adjusting slot and said engaging slots to move from said length adjusting slot to said engaging slot past said first end of said engaging slot to said second end thereof to place said handle in said engaged condition.

5. The adjustable length handle of claim 4 further comprising a secondary shaped section at said second end of one or more of said engaging slots, said secondary shaped section sized and configured to receive said engaging member when said handle is in said engaged condition.

6. The adjustable length handle of claim 4, wherein said length adjusting slot and said first end of said engaging slots define a slot intersection, said slot intersection structured and arranged to allow said engaging member to smoothly transition between said length adjusting slot and said engaging slot to move said handle to said engaged condition.

7. The adjustable length handle of claim 1, wherein said handle body of said first handle member defines a longitudinal axis for said first handle member and said handle body of said second handle member defines a longitudinal axis for said second handle member, said longitudinal axis of said handle being aligned with each of said longitudinal axis of said first handle member and said longitudinal axis of said second handle member.

8. The adjustable length handle of claim 1, wherein one of said first handle member and said second handle member is attached to or integral with a work portion to define a tool.

9. The tool of claim 1, wherein said sealing plate comprising a brush-like component around said first handle member operable to scrape debris from said outer surface of said first handle.

10. An adjustable length handle, comprising:

a first handle member having a handle body with a first end, a second end and an outer surface;

a tubular shaped second handle member having a handle body, a first end, a second end, an outer surface and an interior channel, said interior channel defining an inner surface, said first handle member moveably received in said interior channel so as to have said outer surface of said first handle member in opposing relation to said inner surface of said interior channel and to define a longitudinal axis of said handle;

an adjusting mechanism interconnecting said outer surface of said first handle member and said inner surface of said second handle member, said adjusting mechanism comprising an engaging member extending outwardly from said outer surface of said handle body of said first handle member, a length adjusting slot longitudinally disposed in said inner surface of said second handle member and one or more engaging slots disposed in said inner surface of said second handle member, each of said engaging slots having a first end passably connected to said length adjusting slot and a second end spaced apart from said length adjusting slot, said engaging member cooperatively sized and configured with said length adjusting slot to move along said length adjusting slot when said handle is in a disengaged condition to allow linear movement of one of said first handle member and said second handle member relative to the other of said first handle member and said second handle member along said longitudinal axis of said handle so as to move said handle between a retracted position and an extended position to select a handle length for said handle, each of said engaging slots cooperatively sized and configured with said engaging member and said length adjusting slot to allow said engaging member to move from said length adjusting slot into one of said engaging slots upon rotational movement of one of said first handle member and said second handle member relative to the other of said first handle member and said second handle member to move said handle to an engaged condition that prevents linear movement of one of said first handle member and the other of said first handle member and said second handle member relative to said first handle member to fixedly establish said handle length; and a ring-shaped sealing plate at a first end of said interior channel, said sealing plate having an aperture sized and configured to allow said outer surface of said first handle member to pass through said sealing plate, prevent the passage of said engaging member, and maintain a tight grip around said first handle member operable to scrape debris from said outer surface of said first handle member.

11. The adjustable length handle of claim 10 further comprising a secondary shaped section at said second end of one or more of said engaging slots, said secondary shaped section sized and configured to receive said engaging member when said handle is in said engaged condition.

12. The adjustable length handle of claim 10, wherein said length adjusting slot and said first end of said engaging slots define a slot intersection, said slot intersection structured and arranged to allow said engaging member to smoothly transition between said length adjusting slot and said engaging slot to move said handle to said engaged condition.

13. The adjustable length handle of claim 10, wherein said handle body of said first handle member defines a longitudinal axis for said first handle member and said handle body of said second handle member defines a longitudinal axis for said second handle member, said longitudinal axis of said handle being aligned with each of said longitudinal axis of said first handle member and said longitudinal axis of said second handle member.

14. The tool of claim 10, wherein said interior channel further comprises an adjustable stop at said first end of said interior channel operable to selectively allow the passage of said first handle member through said sealing plate.

15. The tool of claim 10, wherein said sealing plate further comprises a brush extending inward toward the aperture of the sealing plate operable to scrape debris from said outer surface of said first handle.

16. A tool, comprising:

a work portion;

an adjustable length handle having an elongated first handle member, a tubular shaped elongated second handle member having an interior channel in which said first handle member is moveably received and an adjusting mechanism interconnecting said first handle member and said second handle member, one of said first handle member and said second handle member attached to or integral with said work portion, said interior channel of said second handle member defining an inner surface in opposing relation to an outer surface of said first handle member so as to define a longitudinal axis of said handle, said adjusting mechanism having an engaging member extending outwardly from said outer surface of said first handle member, a length adjusting slot longitudinally disposed in said inner surface of said second handle member and one or more engaging slots disposed in said inner surface of said second handle member, each of said engaging slots having a first end passably connected to said length adjusting slot and a second end spaced apart from said length adjusting slot, said engaging member being cooperatively sized and configured with said length adjusting slot to move along said length adjusting slot when said handle is in a disengaged condition to allow linear movement of one of said first handle member and said second handle member relative to the other of said first handle member and said second handle member along said longitudinal axis of said handle so as to move said handle between a retracted position and an extended position to select a handle length for said handle, each of said engaging slots cooperatively sized and configured with said engaging member and said length adjusting slot to allow said engaging member to move from said length adjusting slot into one of said engaging slots upon rotational movement of one of said first handle member and said second handle member relative to the other of said first handle member and said second handle member to move said handle to an engaged condition that prevents linear movement of said second handle member relative to said first handle member to fixedly establish said handle length; and a ring-shaped sealing plate and adjustable stop at a first end of said interior channel, said sealing plate having an aperture sized and configured to allow said outer surface of said first handle member to pass through said sealing plate and maintain a tight grip around said first handle member operable to scrape debris from said outer surface of said first handle member, and wherein said adjustable stop is configured to selectively allow passage of said engaging member through said sealing plate.

17. The tool of claim 16 further comprising a secondary shaped section at said second end of one or more of said engaging slots, said secondary shaped section sized and configured to receive said engaging member when said handle is in said engaged condition.

18. The tool of claim 16, wherein said first handle member has a handle body defining a longitudinal axis for said first handle member and said second handle member has a handle body defining a longitudinal axis for said second handle member, said longitudinal axis of said handle being aligned with each of said longitudinal axis of said first handle member and said longitudinal axis of said second handle member.

19. The tool of claim 16, wherein said interior channel has a first end at a first end of said second handle member and a second end disposed towards a second end of said second handle member.

20. The tool of claim 16, wherein said sealing plate comprising a brush-like component around said first handle member operable to scrape debris from said outer surface of said first handle.

* * * * *